US008910461B2

(12) United States Patent
Liao

(10) Patent No.: US 8,910,461 B2
(45) Date of Patent: Dec. 16, 2014

(54) SIZE-COVERED COMPOSITE YARNS AND METHOD FOR MAKING SAME

(71) Applicant: INVISTA North America S.a r.l., Wilmington, DE (US)

(72) Inventor: Tianyi Liao, Chadds Ford, PA (US)

(73) Assignee: INVISTA North America S.a r.l., Wilmington, DE (US)

( * ) Notice: Subject to any disclaimer, the term of this patent is extended or adjusted under 35 U.S.C. 154(b) by 0 days.

(21) Appl. No.: 13/679,147

(22) Filed: Nov. 16, 2012

(65) Prior Publication Data

US 2013/0118143 A1 May 16, 2013

Related U.S. Application Data

(62) Division of application No. 10/728,358, filed on Dec. 3, 2003, now abandoned.

(51) Int. Cl.

| | |
|---|---|
| ***D02G 3/40*** | (2006.01) |
| ***D02G 3/36*** | (2006.01) |
| ***D02G 3/32*** | (2006.01) |
| ***D02G 3/04*** | (2006.01) |
| ***D01H 5/00*** | (2006.01) |

(52) U.S. Cl.

CPC ..... *D02G 3/404* (2013.01); *D02G 3/36* (2013.01); *D02G 3/328* (2013.01); *D02G 3/04* (2013.01); *D01H 5/00* (2013.01); *D02G 3/406* (2013.01)

USPC ..... 57/7; 57/241

(58) Field of Classification Search

USPC ..... 57/7, 238, 239, 241, 242, 297, 314

See application file for complete search history.

(56) References Cited

U.S. PATENT DOCUMENTS

| | | | | |
|---|---|---|---|---|
| 3,987,614 | A * | 10/1976 | Cardinal et al. | 57/239 |
| 4,551,382 | A * | 11/1985 | Gagne et al. | 442/187 |
| 6,316,088 | B1 * | 11/2001 | Ogawa et al. | 428/297.4 |
| 6,393,817 | B1 * | 5/2002 | Coro | 57/290 |
| 6,454,975 | B1 * | 9/2002 | O'Mara et al. | 264/78 |
| 6,704,980 | B1 * | 3/2004 | Yamamoto et al. | 28/178 |
| 2004/0128973 | A1 * | 7/2004 | Morikawa | 57/238 |
| 2005/0124245 | A1 * | 6/2005 | Liao | 442/197 |

* cited by examiner

*Primary Examiner* — Shaun R Hurley

(74) *Attorney, Agent, or Firm* — Christina W. Geerlof

(57) ABSTRACT

Composite yarns, comprising one or more elastomeric fibers and hard yarns, are formed by adhering the elastomeric fibers and hard yarns together using a size material. The size-covered composite yarn can be used in weaving and knitting to make stretch fabrics with desired garment characteristics. The size material may be removed by subsequent wet fabric processing.

7 Claims, 5 Drawing Sheets

SIZE-COVERED COMPOSITE YARNS AND METHOD FOR MAKING SAME

FIELD OF THE INVENTION

The present invention relates to the manufacture of composite yarns and their use in the manufacture of woven and knit stretch fabrics, as well as garments. More specifically, the invention is a method whereby elastomeric fibers and a relatively inelastic companion yarn are covered and bonded together with a size material that stabilizes and protects the elastomeric fibers during weaving or knitting processes.

BACKGROUND OF THE INVENTION

Elastomeric fibers are commonly used to provide stretch and elastic recovery in woven and knit fabrics and garments. "Elastomeric fibers" are either a continuous filament (optionally a coalesced multifilament) or a plurality of filaments, free of diluents, which has a break elongation in excess of 100% independent of any crimp. An elastomeric fiber when (1) stretched to twice its length; (2) held for one minute; and (3) released, retracts to less than 1.5 times its original length within one minute of being released. As used in the text of this specification, "elastomeric fibers" should be interpreted to mean at least one elastomeric fiber or filament. Such elastomeric fibers include but are not limited to rubber filament, biconstituent filament and elastoester, lastol, and spandex.

"Spandex" is a manufactured filament in which the filament-forming substance is a long chain synthetic polymer comprised of at least 85% by weight of segmented polyurethane.

"Elastoester" is a manufactured filament in which the fiber forming substance is a long chain synthetic polymer composed of at least 50% by weight of aliphatic polyether and at least 35% by weight of polyester.

"Biconstituent filament" is a continuous filament comprising at least two polymers adhered to each other along the length of the filament, each polymer being in a different generic class, for example, an elastomeric polyetheramide core and a polyamide sheath with lobes or wings.

"Lastol" is a fiber of cross-linked synthetic polymer, with low but significant crystallinity, composed of at least 95 percent by weight of ethylene and at least one other olefin unit. This fiber is substantially elastic and heat resistant.

For woven and knit stretch fabrics, modest proportions of elastomeric fibers are used in combination with relatively inelastic fibers, such as polyester, cotton, nylon, rayon or wool. For the purposes of this specification, such relatively inelastic fibers will be termed "hard" fibers. The proportion of elastomeric fibers in a fabric might vary from about 1% to about 15% by weight to provide desired stretch and recovery properties of the fabric.

In fabrics, elastomeric fibers are used as "bare" fibers or as "covered" fibers, depending on the fabric-making process and the product application. A "covered" elastomeric fiber is one surrounded by, twisted with, or intermingled with hard yarn. The covered yarn that comprises elastomeric fibers and hard yarns is also termed a "composite yarn" in the text of this specification. The hard yarn covering serves to protect the elastomeric fibers from abrasion during weaving and knitting processes. Such abrasion can result in breaks in the elastomeric fiber with consequential process interruptions and undesired fabric nonuniformities. Further, the covering helps to stabilize the elastomeric fiber elastic behavior, so that the composite yarn elongation can be more uniformly controlled during weaving processes than would be possible with bare elastomeric fibers.

Background art processes used for covering elastomeric fibers are typically slow, costly and/or limited in application. These processes include: (a) single wrapping of the elastomeric fibers with a hard yarn; (b) double wrapping of the elastomeric fibers with a hard yarn; (c) continuously covering (i.e., core-spinning) an elastomeric fiber with staple fibers, followed by twisting during winding; (d) intermingling and entangling elastomeric and hard yarns with an air jet; and (e) twisting elastomeric fibers and hard yarns together. FIG. 1A to FIG. 1F are schematic representations of conventionally covered composite yarns, wherein one or more hard yarns cover one or more elastomeric fibers. FIG. 1A shows a hard yarn 1 wrapped around elastomeric fibers 3 (i.e., single-wrapped), and FIG. 1B shows two hard yarns 5, 6 wrapped around elastomeric fibers 7 (i.e., double-wrapped). FIG. 1C shows a core-spun yarn wherein the elastomeric fibers 11 are covered with staple fibers 9. FIG. 1D shows a twisted hard-yarn pair 13, 14 wrapped around elastomeric fibers 15, as accomplished by the Elasto Twist® system of Hamel AG. FIG. 1E shows two hard yarns 17, 19 twisted with elastomeric fibers 21 in a two-for-one twist structure. FIG. 1F shows a multifilament hard yarn 22 intermingled with elastomeric fibers 23, as done in an air-jet covering process.

Operating speeds for these wrapping and twisting processes are typically about 25 meters/minute. The air-jet covering process can be operated at speeds up to 500 meters/minute and more. However, the air-jet covering process is limited to the use of continuous filament hard yarns, wherein the filaments have previously been textured (e.g., false-twist textured). For widely used staple fibers, such as cotton, wool and linen, or for non-textured continuous filaments, the traditional, slower covering methods are currently used.

Knitting processes can use either bare or covered elastomeric fibers to produce stretch knit fabrics for garments. The choice depends on the type of garment and its desired aesthetics and performance in use. However, for weaving processes to make stretch woven fabrics, industry practice is to use the more costly composite yarn (e.g., covered elastomeric fibers) in the warp only, or in the weft only, or in both the warp and the weft.

Further, it is customary in weaving operations to prepare the warp yarns with a coating of size, whether the warp is made from hard yarns or composite yarns. "Size" is an adhesive coating made from materials such as starch or polyvinyl alcohol (PVA). When applied to the warp yarns, size helps to provide a smooth yarn surface and to increase the strength of the warp yarns. In weaving, the warp yarns are subjected to friction and high forces during the action of the shedding mechanisms. Size is used with warp yarns to reduce yarn breaks during processing. Practically all of the size is removed from the yarns during fabric wet-finishing operations.

Background art composite yarns comprised of spun cotton and elastomeric fiber(s) are typically dyed as packages before use in weaving, but there are disadvantages to such dyeing. Specifically, the elastomeric core yarn will retract at the hot water temperatures used in package dyeing. In addition, the composite yarn on the package will compress and become very tight, thereby impeding the flow of dyestuffs into the interior of the yarn package. This can often result in yarn with different color shades and stretch levels, depending on the yarn's diametral position within the dyed package. Small packages are sometimes used for dyeing core-spun composite yarns to reduce this problem. However, small-package dyeing is relatively expensive because of extra packaging and handling requirements.

Although common industry practices are highlighted above, additional background art provides alternative suggestions to improve weaving processes or products. For example, U.S. Pat. No. 3,169,558 discloses a woven fabric with bare spandex in one direction (e.g., warp) and hard yarns in the other direction (e.g., weft). However, the bare spandex must be drawn and substantially twisted in a separate, costly operation prior to using it in the weft or the warp. For example, a 100 dernier bare spandex fiber, drafted 4×, must have 18.25 twists per inch, as a minimum.

Great Britain Pat. No. GB 1513273 discloses a warp-stretch woven fabric and process wherein pairs of warp yarns, each pair having one or more bare elastomeric fibers and a secondary hard yarn, are passed in parallel and at different tensions through the same heald eyelet and dent. Achieving weft stretch by using elastomeric fibers is also described as possible, but by using conventionally-covered composite yarns in the weft. Size is not applied.

Japanese Pat. No. 4733754 discloses a method to manufacture stretch woven fabrics in a way that manages the elongation of sensitive spandex during weaving. An elastomeric strand is lightly wound (wrapped) with a PVA-based fiber strand, and then the two strands are twisted together to form a yarn B. The yarn B can be optionally sized to further arrest stretchability during weaving. The PVA fiber strand is later dissolved during fabric wet processing to provide a stretch product. Further, an elastic yarn C is made by wrapping yarn B with various continuous (synthetic) fiber strands, and then is optionally sized. Both yarns B and C can be used in the warp or weft to provide elastic fabrics. However, this method to make stretch-woven fabrics requires use of composite yarns made by wrapping, as well as optional use of size.

Japanese published Application No. 200213045 discloses a process used to manufacture a warp-stretch woven fabric using both composite and hard yarns in the warp. The composite yarn comprises polyurethane yarn wrapped with a synthetic multifilament hard yarn and then coated with size material. The construction of the composite is that of the composite yarns represented in FIG. 1A and FIG. 1B, before coating with size material. The composite yarn is used in the warp in various proportions to a separate synthetic multifilament hard yarn in order to achieve the desired properties of stretch in the warp direction. This composite yarn and method were developed to manufacture warp-stretch fabrics, and to avoid difficulties in the weaving of weft-stretch fabrics. However, the method is costly as it uses traditional, slow, wrapping processes to cover the polyurethane yarn with a covering of multifilament hard yarn.

Therefore, there is a need in the art to provide "covered" elastomeric fibers that can be: (1) sufficiently protected and stable for use in weaving and knitting operations; (2) applied in a variety of woven and knit fabrics; and (3) applied in manufacturing at higher speeds and lower costs than those produced by background art covering methods.

SUMMARY OF THE INVENTION

It has been discovered unexpectedly that size alone can provide a "covering" that is sufficient to maintain the integrity of a composite yarn of elastomeric fibers and hard yarn and to protect the elastomeric fibers component in the composite yarn from damage during knitting or weaving processes. In addition, due to the unique structure of the size-covered composite yarn, the elastomeric fibers and the companion hard yarn are substantially freed from one another in the fabric after the size is removed in wet-finishing operations. This feature results in woven and knit fabrics with appealing tactile properties known in the art as "hand." Further, "size-covered" composite yarns can be manufactured at high speeds that are comparable to those of air jet covering processes.

One exemplary embodiment of the present invention is a method for making a composite yarn, comprising: stretching a strand of at least one elastomeric fiber in a range from 1.1× to at least 5× of a relaxed length of the strand; aligning at least one hard yarn selected from the group consisting of synthetic fibers, natural fibers and a blend of synthetic and natural fibers, adjacent and substantially parallel to said stretched strand to form an aligned yarn; applying a size material to said aligned yarn; and drying or curing the size material to form a composite yarn.

Another exemplary embodiment of the invention is a composite yarn, comprising: at least one elastomeric fibers forming a strand with a total draft from in a range from 1.2× to at least 6.2× of an original spun length of the strand; at least one hard yarn selected from the group consisting of: synthetic fibers, natural fibers and a blend of synthetic and natural fibers, wherein said hard yarn is aligned adjacent and substantially parallel to said strand to make an aligned yarn; and a dried or cured size material forming an adhesive that adheres the strand and hard yarn of the aligned yarn together.

Yet another exemplary embodiment of the present invention is an elastic woven fabric after final finishing, comprising: strands of bare, essentially untwisted, elastomeric fibers in the weft that are substantially parallel and adjacent to hard yarns in the weft.

Yet again another exemplary embodiment of the present invention is an elastic woven fabric after final finishing, comprising: strands of bare, essentially untwisted elastomeric fibers in the warp that are substantially parallel and adjacent to hard yarns in the warp, wherein the ratio of said elastomeric fibers to hard yarns in the warp ranges from 1:2 to 1:4.

DETAILED DESCRIPTION OF THE INVENTION

Size-covered composite yarns are alternatives to elastic composite yarns conventionally-covered with hard yarns, such as in single-wrapping, double-wrapping, core spinning, twisting, or air jet entangling as discussed above. Size-covered yarns have significant economic and product advantages compared to the conventionally covered yarns. For example, the size-covering method can be operated at speeds as high as 500 meters/minute or more. The typical speed of size covering is more than ten (10) times the speed of other covering processes, except for air-jet covering methods. However, air-jet methods are limited in practice to use of synthetic continuous-filament covering yarns that have been textured or crimped in some way to facilitate jet-induced entanglement and intermingling. There is no limit on the type of companion hard yarn that may be used with the elastomeric fibers in the size-covering method of the invention.

Figure 2A:
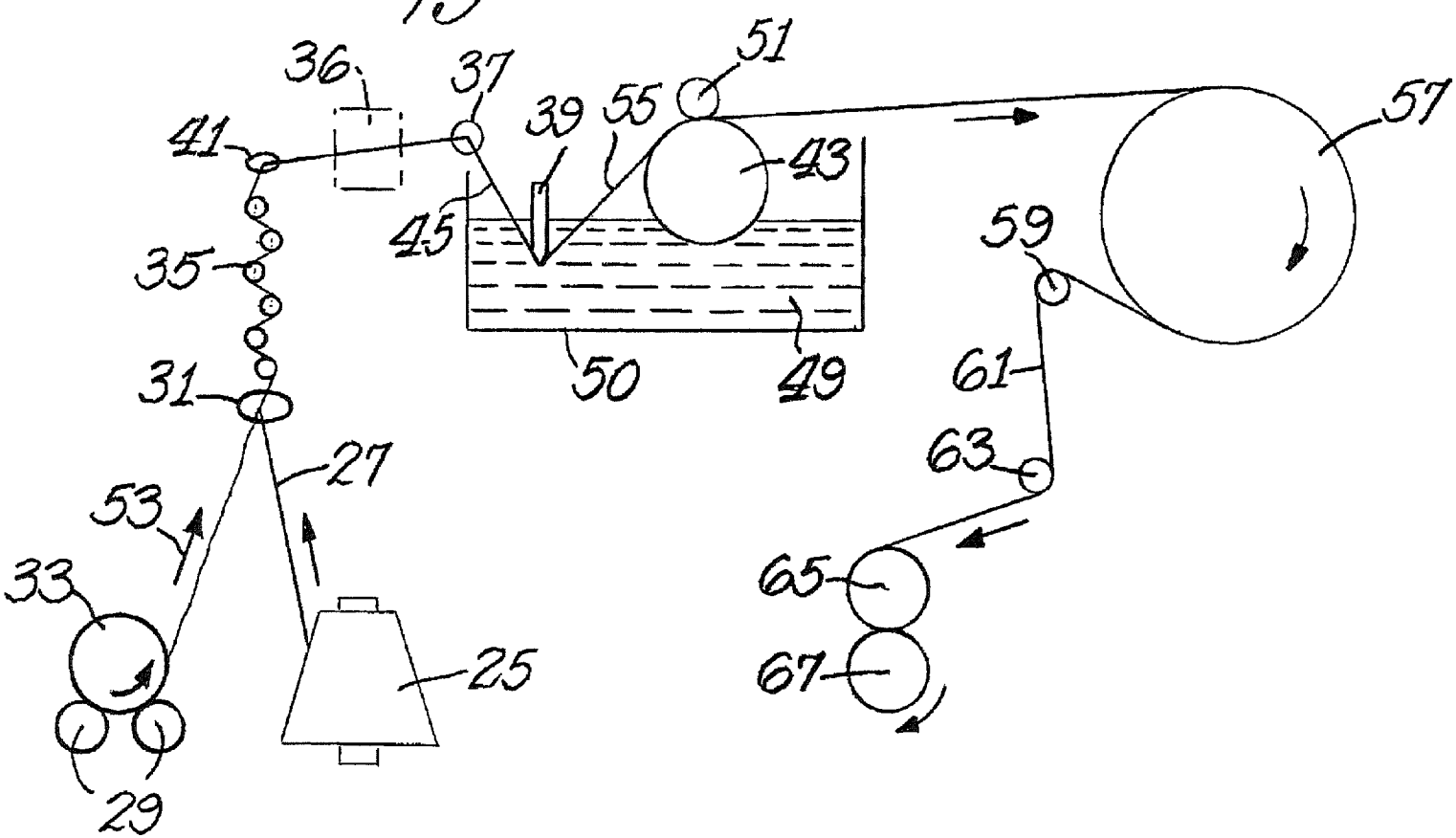
FIG. 2A shows a non-limiting system schematic diagram of a system for manufacturing size-covered composite yarn of the invention.

An embodiment of a system that can implement the method of the invention is shown in the non-limiting schematic diagram in FIG. 2A. The process equipment as shown is used in manufacturing elastomeric fibers discussed in the examples given below. The particular equipment used is not to be interpreted as limiting in regard to enabling the method of the invention.

A pair of motor-driven rolls 29 is used to control the surface speed of the elastomeric fibers supply package 33 and to meter the delivery of one or usually multiple elastomeric fibers 53 preferably at a constant rate. Spandex is a non-limiting example of a preferred elastomeric fiber 53. If spandex is used as the elastomeric fiber, preferably, the spandex has a linear density ranging from 20 denier to 140 denier, and most preferably from 20 denier to 70 denier.

The surface speed of the sizing wheel 43 is set at a higher speed than the elastomeric fibers supply package 33, so that the elastomeric fibers are thus machine-drafted (i.e., stretched) in a range not limited to a total of about 1.1× to at least 5×. If spandex is used in this invention, a machine draft range of 1.1× to 4× is preferred, and the actual setting will depend on the type and denier of spandex supplied. This machine-draft value does not include any residual drafting or drawing of the elastomeric fibers that occurs on the package (e.g., a bobbin) of the elastomeric as-spun yarn. This residual draft is termed package relaxation (PR) so that the total value of draft from subsequent processing is $D_t=(V_1/V_2)*(1+PR)$, where $D_t$ is the total draft, and $V_1/V_2$ is the draft ratio of sizing wheel 43 and elastomeric fiber supply package 33 peripheral surface speeds. The ratio V1/V2 is also termed the machine draft. Typically, the PR number varies from 0.05 to 0.25.

In addition, FIG. 2A shows a hard yarn 27 that is withdrawn from a hard yarn supply package 25 at a speed that is about the same as the surface speed of the sizing wheel 43, but sufficiently different to provide some tension in the hard yarn. This hard yarn 27 can be of staple or continuous filament fibers, and there is no known limit on the type of hard yarn material that can be used in the size-covering process.

For staple yarns, the material can be, but is not limited to, cotton, wool, polyester, nylon, polypropylene, or blends thereof. In addition, the yarn can be made from various yarn spinning processes, such as ring spun, open end, air jet, etc. For continuous filament yarns, the fibers can be, but are not limited to, synthetic materials, such as polyester, nylon, rayon, polypropylene, etc., and the filaments can be either textured or flat (untextured). Although not intended to be limiting herein, the linear density of the hard yarn preferably ranges from 45 denier to 900 denier, and the range of 45 to 600 denier is most preferred.

In the embodiment of the invention shown in FIG. 2A, the elastomeric fibers 53 and the hard yarn 27 are both directed through a first guide 31 and then to a serpentine (gate) tensioner 35 that serves to align the elastomeric fibers 53 and hard yarns 27 in an adjacent and substantially parallel manner. The elastomeric fibers 53 and the hard yarn 27 form an aligned yarn 45. The aligned yarn 45 is directed through a post-tensioner guide 41 at the exit of the serpentine (gate) tensioner 35 and then into the sizing solution bath 49 by a change of direction roll 37. The aligned yarn 45 is immersed in the sizing solution 49 by the action of the immersion lever 39 to allow the solution to wet the elastomeric fibers 53 and hard yarn 27 forming the aligned yarn 45.

The sizing solution preferably comprises a sizing material and water, and the sizing material preferably comprises a sizing agent and a wax. There is no particular limit as to the type of sizing agent, and any known type can be used. Normal sizing agents for textiles, well known by those skilled in the art, can be selected for the size-covering application. Such materials include, but are not limited to, starch, acrylic polymer, polyvinyl alcohol (PVA) and CMC® (a trade name for etherized hemicellulose). The wax can be an olefin polymer or other acceptable waxes that are known to those skilled in the art.

The concentrations of sizing agent and wax in the sizing solution 49 are measured as the % solids weight of the sizing agent and wax materials, compared to the total weight of the bath liquid. The concentration of size material in the aqueous sizing solution 49 can range from 5% to 25%, depending on the particular size material and the type and denier of the hard yarn 27. The wax, which is an optional constituent of the size material, can range from 0% to 1%, with 0.2% to 0.6% preferred, and with 0.5% most preferred. When using PVA sizing agent with a cotton hard yarn in the preferred denier range, it is preferred that the PVA solids concentration range from about 10% to about 20%.

The sizing solution temperature should range from about 50 to about 90 degrees Centigrade, preferably from about 55 to about 80 degrees Centigrade, and more preferably from about 55 to about 70 degrees Centigrade.

As shown in FIG. 2A, the composite yarn 55 comprising the elastomeric fibers 53 and hard yarn 27, coated with wet size material, exits the sizing solution 49 and passes through a nip between the sizing roll 43 and a pressure (i.e., squeeze) roll 51. The types and deniers of the elastomeric fibers 53 and hard yarn 27, the concentration of size material in the sizing solution 49, and the pressure exerted by the pressure roll 51 together determine the final amount of size material covering the wet size-covered composite yarn 55. For a given composite yarn and sizing wheel 43 speed, the concentration of size material in the sizing solution 49 and the pressure roll 51 pressure are set to provide the desired size material weight on the dried size-covered composite yarn 61. The surface speed of the sizing roll wheel 43, and hence the speed of the sizing process, can range from 10 to 700 meters per minute. For cotton hard yarns 27, the preferred speed ranges from about 150 to about 400 meters per minute.

After passing through the nip between the sizing roll 43 and the pressure roll 51, the wet-size covered composite yarn 55 must be thoroughly dried to provide the dried size-covered composite yarn 61 before the size-covered composite yarn is wound on a size-covered composite yarn package 67. It is usually very obvious if the dried size-covered composite yarn 61 is not fully dry, as there will be deposits of size material on the windup traverse mechanisms 65, and/or the wound package 67 will be difficult or impossible to unwind.

A common method of drying is schematically shown in FIG. 2A, although the invention is not limited to this method. The wet size-covered yarn 55 is wrapped a plurality of times around a perforated cylindrical drum 57 that allows hot air to flow over and around the wraps of wet size-covered yarn 55. It is preferred that the hot air temperature range from about 60 to about 90 degrees Centigrade, and a range of about 60 to about 80 degrees Centigrade is more preferred. For such a hot air drying process, the residence time of the wet size-covered composite yarn 55 on the drying drum is about five (5) minutes. This is achieved through the combination of drum size, drum surface speed, number of yarn wraps on the perforated cylindrical drum 57. The dried size-covered composite yarn 61 then leaves the perforated cylindrical drum 57 and proceeds over change of direction rolls 59, 63 to windup roll 65 used to wind the size-covered composite yarn 61 on the size-covered composite yarn package 67.

The dried size material that constitutes the covering of the size-covered composite yarn 61 preferably should be in a range of 3% to 20% by weight of the pre-sized yarn weight. We have found that an applied level of size less than about 3% failed to cover sufficiently the surface of the composite yarn, resulting in poor adhesion between fibers, thread exposure, and/or breaks in the elastomeric fiber during subsequent processing. We further believe that percentages of size exceeding 20% increase size consumption without benefit, and may result in the reduced ability of fabric wet-finishing processes to remove the size. Nevertheless, persons of skill may find that amounts outside this range will perform acceptably. The more preferred amount of size ranges from 5% to 12% by weight. For a particular composite yarn, the adequacy of the size covering can be tested by the manual "Adhesion Test" described in the Analytical Methods section below.

In another embodiment of the method of the invention, the size material is non-aqueous, and comprises a hot-melt polymer sizing agent and a wax. Such a size material is non-aqueous when applied to the composite yarn, but can be removed in fabric wet-finishing operations. The alternate type of size material is preferably a mixture of a heat-meltable polymer, such as an acrylate ester or methacrylate ester, and a wax, such as olefin polymer. Because the size material is non-aqueous, it does not require water to be removed in a drying step as compared with the embodiment illustrated in FIG. 2A in which drying over perforated drum 57 was shown. Thus, water removal by drying and the associated expense are not required, which is an advantage. The hot melt sizing agent and wax are typically applied to the aligned yarns 45 by an application nozzle (e.g., jet spray), or by immersion of the aligned yarns into a sizing solution 49 of the size material. The amount of non-aqueous size material applied to the aligned yarn 45 ranges from about 3% to about 6% by weight of the pre-sized aligned yarn 45 weight. The hot-melt size material is dried or cured at temperatures ranging from 20 to 70 degrees Centigrade, and preferably from 35 to 45 degrees Centigrade. The size is removed from the size-covered composite yarn 61 during subsequent fabric wet-finishing operations.

Figure 2B:
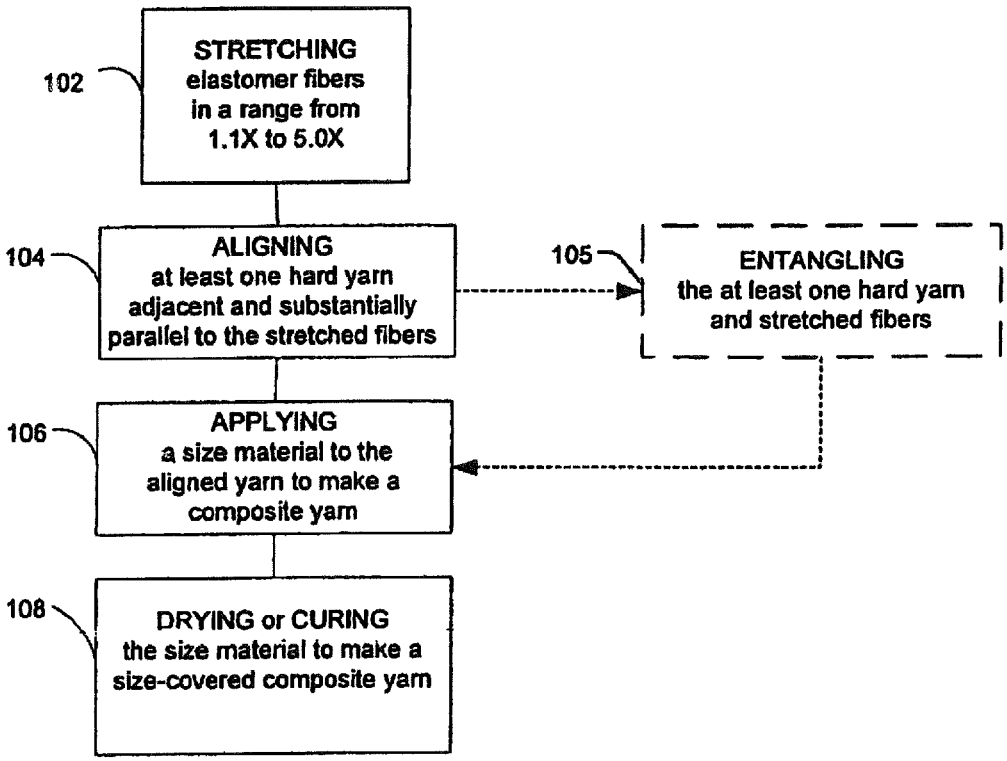
FIG. 2B shows a non-limiting flow diagram of a method for making a composite yarn of the invention.

FIG. 2B shows a flow diagram of one embodiment of the method of the invention. In step 102 of FIG. 2B, the multiple elastomeric fibers are stretched in a range from 1.1× to at least 5.0× a relaxed length of the elastomeric fibers. Next, a hard yarn is placed adjacent and substantially parallel to the elastomeric fibers to make an aligned yarn, as shown in step 104. Step 106 of FIG. 2B is applying a size material to the aligned yarn. Example methods for performing Step 106 include but are not limited to dipping the aligned yarn in a size bath, passing the aligned yarn through a liquid size application nozzle, spraying the aligned yarn with size or passing the aligned yarn over the size-covered surface of a rotating roll. The size material applied to the aligned yarn is dried or cured to make a size-covered composite yarn in step 108. Example methods for performing step 108 include but are not limited to radiant heating and forced air convection.

Figure 3A:
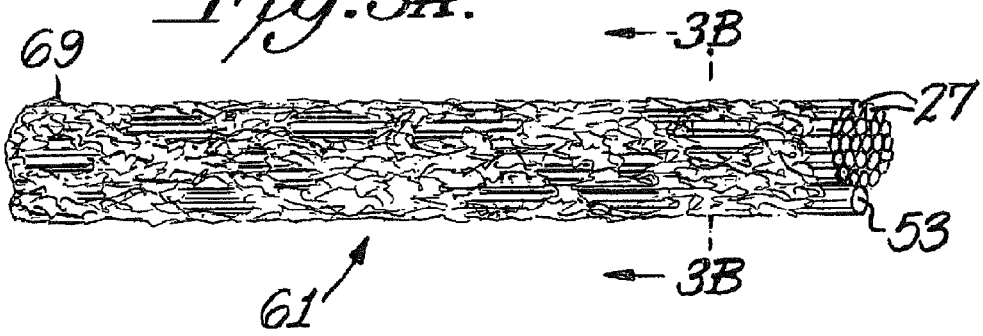
FIG. 3A shows a non-limiting example drawing of a size-covered composite yarn of the invention.
Figure 3B:
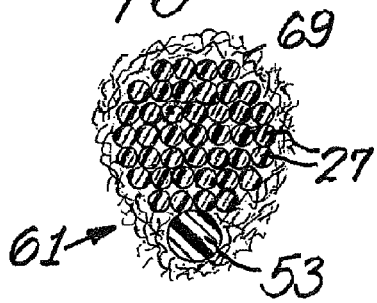
FIG. 3B shows the cross-section of a non-limiting example of size-covered composite yarn of the invention.

FIG. 3A and FIG. 3B are representations of the structure of the size-covered composite yarns of the invention, showing the elastomeric fibers, the hard yarn(s) and the size covering. FIG. 3A is a side view of the size-covered composite yarn 61, showing the position of the elastomeric fibers 53 as adjacent and substantially parallel to the hard yarn(s) 27, with a size material 69 covering. The elastomeric fibers 53 are essentially untwisted. FIG. 3B is a cross section, taken along line 3B-3B of FIG. 3A, showing the individual filaments of the hard yarn 27, the elastomeric fiber 53 and the size material 69 making up the composite yarn 61. The unique structure of the size-covered composite yarn 61 shown in FIG. 3A and FIG. 3B of the invention is readily apparent when it is compared to structures of background art covered composite yarns of FIG. 1A to FIG. 1F.

Size material 69 is removed from the composite yarn in fabric wet-finishing operations such as de-sizing, scouring and dyeing. In the fabric, the elastomeric fibers 53 then lay parallel to their companion hard yarns 27 and are free to extend and recover in the fabric, unrestrained by the size. When woven, the resulting fabric has a distinctive, woven fabric "hand" that provides an advantage in garment applications not found with the composite yarns of FIGS. 1A to 1F.

Figure 1A:
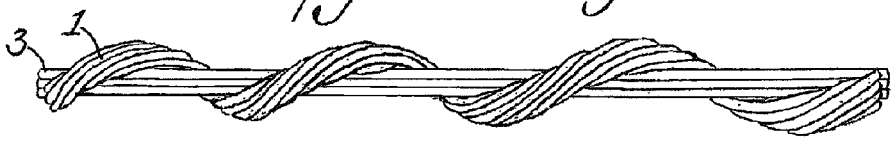
Fig. 1A (Background Art)
FIG. 1A shows a background art example of multiple elastomeric fibers forming a strand with a wrapped, single-covered yarn over the strand.
Figure 1B:
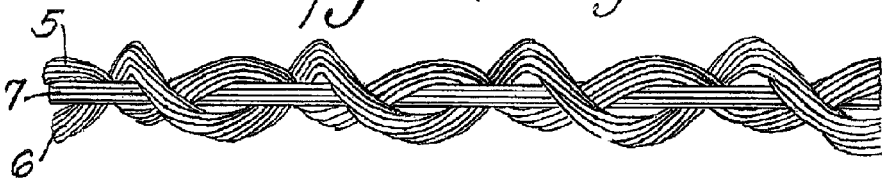
Fig. 1B (Background Art)
FIG. 1B shows a background art example of multiple elastomeric fibers forming a strand with a wrapped, double-covered yarn over the strand.
Figure 1C:
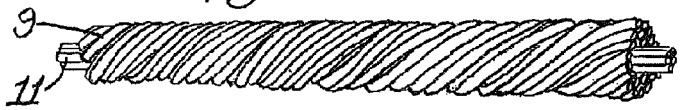
Fig. 1C (Background Art)
FIG. 1C shows a background art example of multiple elastomeric fibers forming a strand with core-spun covered yarn over the strand.
Figure 1D:
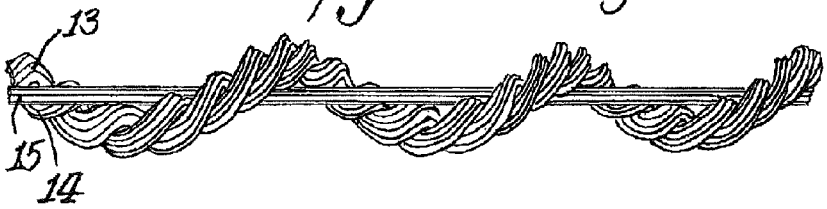
Fig. 1D (Background Art)
FIG. 1D shows a background art example of multiple elastomeric fibers forming a strand with a Hamel* twisted-pair covered yarn.
Figure 1E:
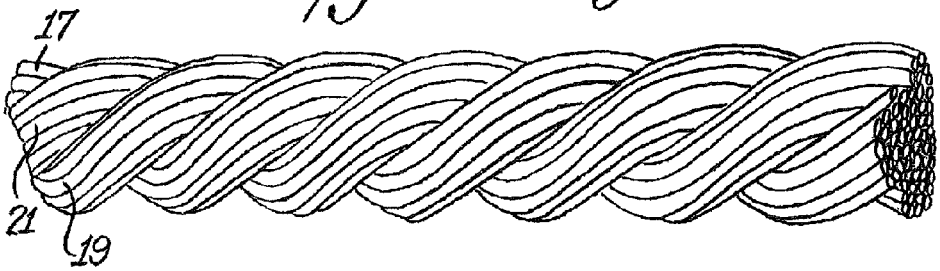
Fig. 1E (Background Art)
FIG. 1E, shows a background art example of multiple elastomeric fibers forming a strand over which a pair of hard yarns has been twisted.
Figure 1F:
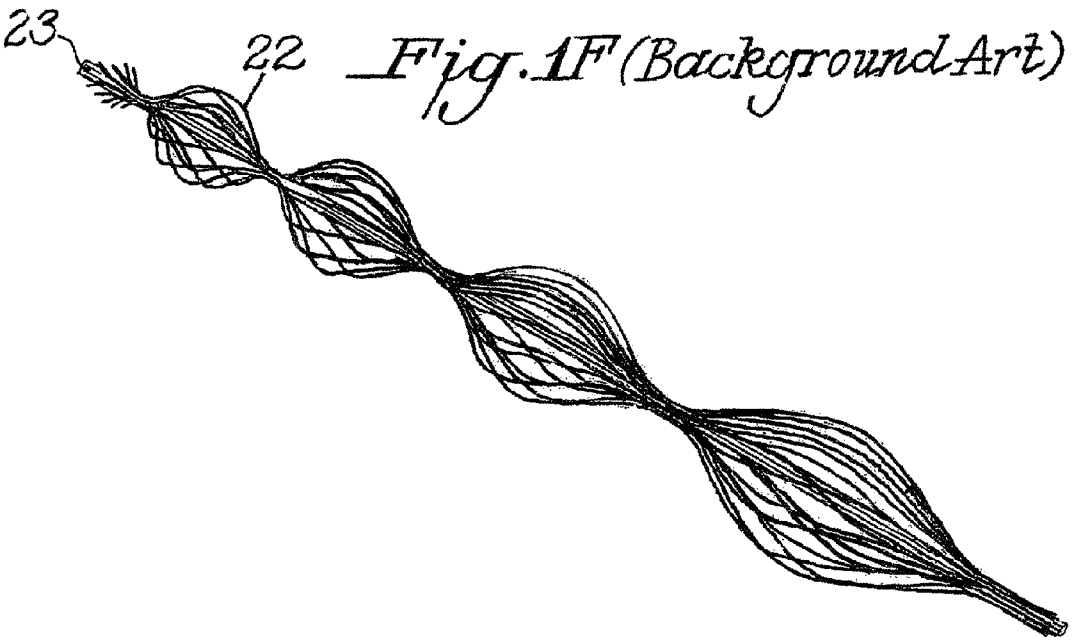
Fig. 1F (Background Art)
FIG. 1F shows a background art example of multiple elastomeric fibers forming a strand with an air-jet covered yarn over the strand.

An advantage of the method of this invention is that staple hard yarns, such as cotton, can be dyed before they are combined with elastomeric fibers by applying size. Traditionally, composite yarns of staple and elastomeric fibers are simultaneously spun into a composite yarn as the elastomeric fibers are fed into the core of the spun fibers (i.e., core spinning, as shown in FIG. 1C). As a result, dyeing of the cotton yarn must be after the cotton and elastomeric fibers are combined, rather than optionally before, as is possible with the method of the present invention. The ability to dye the cotton separately, before covering, eliminates problems of non-uniform package dyeing as described above.

In the above-described embodiments of the invention, the elastomeric fibers 53 and the hard yarn 27 are adjacent and substantially parallel to one another before and after the size material is applied. When the hard yarn is a spun yarn of staple fibers, such as cotton or cotton blends, hard yarn staple filament ends project from the surface of the yarn. These ends give the spun yarn a "hairy" appearance or characteristic. To assist in achieving adhesion between the spun hard yarn and the elastomeric fibers, an optional air-jet entangling mechanism 36 (see FIG. 2A) can be added after the post-tensioner guide 41, and an optional air-jet entangling step 105 (see FIG. 2B) may be added before the step 106 of applying size material. In the air jet, the surface-projecting hard yarn ends entangle with the elastomeric fibers, while still maintaining the position of the elastomeric fibers generally parallel and external to the hard yarn. This entanglement is between the surface staple filament ends and the continuous elastomeric fibers, and it is distinctly different from the intermingling and interlace effects of continuous yarns with elastomeric fibers in prior air jet covering processes. The desired entanglement can be achieved with cotton, for example, by using a Heberlein AG Fiber Technology, Inc. interlace nozzle Model Slide-Jet-HFP operated at an air pressure of 3 to 6 bar, where 4 bar air pressure is preferred.

The dried and size-covered composite yarn 61 on the package 67 is ready to be used for subsequent weaving or knitting processes. The size-covered composite yarn 61 can be used to manufacture woven and knit fabrics, but woven fabrics are preferred. The size-covered composite yarn 61 can be used in weft and warp for wovens, but for size-covered composite yarns using spun staple hard yarns it is preferred to use them in the weft. For woven fabrics, there are no restrictions on the weaving pattern used. However, the size-covered composite yarn 61 preferably should not be used with water-jet weaving machines because the size-covering material generally is water-soluble. The ratio of size-covered composite yarn 61 to hard yarn 27 in the woven fabric, weft and/or warp can range from 1:1 to 1:4. Examples for the use of the size-covered composite yarns 61 of the present invention include, but are not limited to, flat-knit, circular-knit and warp-knit fabrics.

EXAMPLES

Applications of Size-Covered Composite Yarns to the Manufacturing of Stretch Woven and Knit Fabrics The following examples demonstrate the size-covering method of the present invention and its capability for use in manufacturing a variety of composite yarns, and in turn for those composite yarns to be used to make stretch woven and knit fabrics. Size-covered composite yarns 61 were prepared on one position of a 6-single-end-position sizing machine. A non-limiting example of a sizing machine is Type KS-3, Kaji Single End Sizing Machine "Uni Sizer" model number 1101 from Kaji Saisakusno, Co. Ltd of Japan. A portable positive-drive feeder for elastomeric fibers 53 was positioned next to one of the single-end positions. The hard yarn 27 was placed on the yarn feed position of the sizing machine. Both the hard yarn 27 and the elastomeric fibers 53 were directed to the first guide 31, and from there were jointly processed through the sizing, drying and winding operations. Lycra® spandex was used in all the examples. Lycra® is a registered trademark of E.I. DuPont de Nemours and Company for its brand of spandex fiber, The combined yarn processing speed was first set to that of the hard yarn (e.g., 270 meters/minute), and the spandex positive-drive feeder was subsequently set to a speed to provide the desired spandex machine draft (e.g., 77 meters/minute) for a machine draft of 3.5×. For all examples, the sizing agent was a polyvinyl alcohol ("PVA"), and the wax was olefin polymer. The application of size material on the combined yarns was controlled by the % solids concentration of size material in the size bath 50, and by the pressure exerted by the pressure roll 51. The wax concentration was 0.5% in all cases.

No additional weights were added to the pressure roll 51, so that the pressure roll pressure was determined by the weight of the pressure roll 51 and its mechanical mechanism. The concentration of % solids in the sizing bath 50 was confirmed by measurement, using a Bristix® Portable Refractometer made by TechniQuip Corporation. The wet size-covered composite yarn 56 was continuously dried on the machine on a rotating frame in a heated-air enclosure. The rotating frame acts as an accumulator so that the residence time of the yarn is about 5 minutes at 300 meters/minute. With this machine, the rate of processing can be higher with lower-denier composite yarns, as the drying rate is then higher. In all examples, the size was totally dry before the size-covered composite yarn 61 was wound.

The size-covered composite yarns 61 were used in the examples to make both woven and knit fabrics. Woven fabrics were made on air-jet looms. All woven fabrics, with the exception of that of Example 1, were made on a Dornier Air Jet Loom, Type TYD LTV6/S—2000. The woven fabric of Example 1 was made on a Rutio L-5000 Air Jet Loom. The knit fabric of Example 7 was made on a Lonati 462 circular-knitting machine with a single cylinder and in a flat-knit style.

Unless otherwise noted, each greige fabric in the examples was finished by first passing it under low tension through hot water three times at 160° F., 180° F. and 202° F. (71° C., 82° C. and 94° C.), respectively.

Fabrics containing only synthetic hard yarns were de-sized and pre-scoured at 160° F. (71° C.) for 30 minutes. Pre-scouring and de-sizing were in an aqueous solution with 6.0 weight % Synthazyme® (a starch-hydrolyzing enzyme from Dooley Chemicals LLC), 1.0 weight % Lubit® 64 (nonionic lubricant from Sybron, Inc.), and 0.5 weight % Merpol® LFH surfactant (registered trademark of E. I. DuPont de Nemours and Company). The fabric was subsequently scoured at 110° F. (43° C.) for 5 minutes in a solution containing 0.5 weight % trisodium phosphate, 1.0 weight % Lubit® 64 and 1.0 weight % Merpol® LFH. The weight percents are based on the dry fabric weight. The scoured fabrics were then jet dyed with a green, tan, or gray disperse dye at 230° F. (110° C.) for 30 min at pH 5.2, and subsequently heat-set on a tenter frame at 380° F. (193° C.) for 40 seconds.

Each woven greige fabric containing cotton was pre-scoured with 3.0 weight % Lubit®64 at 120° F. (49° C.) for 10 minutes. Afterwards, it was de-sized with 6.0 weight % Synthazyme® and 2.0 weight % Merpol® LFH for 30 minutes at 160° F. (71° C.) and then scoured with 3.0 weight % Lubit® 64, 0.5 weight % Merpol® LFH and 0.5 weight % trisodium phosphate at 180° F. (82° C.) for 30 minutes. The fabric was then bleached with 3.0 weight % Lubit® 64, 15.0 weight % of 35% hydrogen peroxide, and 3.0 weight % sodium silicate at pH 9.5 for 60 minutes at 180° F. (82° C.). Fabric bleaching was followed by beck-dyeing with a tan, black, or green direct dye at 200° F. (93° C.) for 30 minutes and heat-setting at 380 F (193° C.) on a tenter frame for 35 seconds with enough tension to hold the fabric straight in the warp direction without underfeeding.

Analytical Methods Use to Characterize Size-Covered Composite Yarns

Various methods were used to characterize the size-covered composite yarn, the performance of the weaving operations, and the quality of the woven and knitted fabric examples. These methods are described below.

Composite-Yarn Bond Stability

One function of size material used in this invention is to "bond" or "adhere" the elastomeric fibers and hard yarns together, so that the composite yarn will remain consolidated as a unit during the processes of weaving or knitting. Preferably, the size material covers the outer surface of the composite yarn. If the bond between the elastomeric and hard yarns fails significantly at some point, then the elastomeric fibers are no longer "covered" or "adhered", and the chances for yarn breaks during weaving or knitting increase substantially (i.e., the process efficiencies are reduced).

Size-covered composite yarns are tested for bond stability in a simple test. A length of size-covered composite yarn 61 is unwound from the package. The size-covered composite yarn 61 is grasped by hand at points about 13 centimeters apart. The size-covered composite yarn 61 is stretched to its maximum length without breaking, and then allowed to recover to the original length; this is repeated sequentially 5 times in a total time period of about 5 seconds. The size-covered composite yarn 61 sample is then visually examined (between the points of grasp) to see if there is any separation between the elastomeric fibers and the hard yarn. If there is no separation along the sample length, the size-covered composite yarn 61 passes the test—the elastomeric fibers and hard yarn remain adhered together. If there is any separation, the size-covered composite yarn 61 has failed the test. For the examples below, all composite yarn samples were tested as above. Each sample had to pass in order for the bond stability to be rated a PASS in the example.

Weaving Performance

The weaving efficiency was evaluated by loom stop times per 100,000 picks, caused by weft yarn. The acceptable level is less than 5 stops/100,000 picks.

Woven Fabric Elongation (Stretch)

Fabrics are evaluated for % elongation under a specified load (i.e., force) in the fabric stretch direction(s), which is the direction of the composite yarns (i.e., weft, warp, or weft and warp). Three samples of dimensions 60 cm×6.5 cm are cut from the fabric. The long dimension (60 cm) corresponds to the stretch direction. The samples are partially unraveled to reduce the sample widths to 5.0 cm. The samples are then conditioned for at least 16 hours at 20° C.+/−2° C. and 65% relatively humidity, +/−2%.

A first benchmark is made across the width of each sample, at 6.5 cm from a sample end. A second benchmark is made across the sample width at 50.0 cm from the first benchmark. The excess fabric from the second benchmark to the other end of the sample is used to form and stitch a loop into which a metal pin can be inserted. A notch is then cut into the loop so that weights can be attached to the metal pin.

The sample non-loop end is clamped and the fabric sample is hung vertically. A 30 Newton (N) weight (6.75 LB) is attached to the metal pin through the hanging fabric loop, so that the fabric sample is stretched by the weight. The sample is "exercised" by allowing it to be stretched by the weight for three seconds, and then manually relieving the force by lifting the weight. This is done three times. The weight is then allowed to hang freely, thus stretching the fabric sample. The distance in millimeters between the two benchmarks is measured while the fabric is under load, and this distance is designated ML. The original distance between benchmarks (i.e., unstretched distance) is designated GL. The % fabric elongation for each individual sample is calculated as follows:

$$\%\ \text{Elongation}\ (E\%)=((ML-GL)/GL)\times 100.$$

The three elongation results are averaged for the final result.

Woven Fabric Growth (Unrecovered Stretch)

After stretching, a fabric with no growth would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric is tested. For two-way stretch fabric both directions are tested. Three samples, each 55.0 cm×6.0 cm, are cut from the fabric. These are different samples from those used in the elongation test. The 55.0 cm direction should correspond to the stretch direction. The samples are partially unraveled to reduce the sample widths to 5.0 cm. The samples are conditioned at temperature and humidity as in the above elongation test. Two benchmarks exactly 50 cm apart are drawn across the width of the samples.

The known elongation % (E %) from the elongation test is used to calculate a length of the samples at 80% of this known elongation. This is calculated as $$E\ (\text{length})\ \text{at}\ 80\%=(E\%/100)\times 0.80\times L,$$

where L is the original length between the benchmarks (i.e., 50.0 cm). Both ends of a sample are clamped and the sample is stretched until the length between benchmarks equals L+E (length) as calculated above. This stretch is maintained for 30 minutes, after which time the stretching force is released and the sample is allowed to hang freely and relax. After 60 minutes the % growth is measured as $$\%\ \text{Growth}=(L2\times 100)/L,$$

where L2 is the increase in length between the sample benchmarks after relaxation and L is the original length between benchmarks. This % growth will be measured for each sample and the results averaged to determine the growth number.

Woven Fabric Shrinkage

Fabric shrinkage is measured after laundering. The fabric is first conditioned at temperature and humidity as in the elongation and growth tests. Two samples (60 cm×60 cm) are then cut from the fabric. The samples should be taken at least 15 cm away from the selvage. A box of four sides of 40 cm×40 cm is marked on the fabric samples.

The samples are laundered in a washing machine with the samples and a loading fabric. The total washing machine load should be 2 kg of air-dried material, and not more than half the wash should consist of test samples. The laundry is gently washed at a water temperature of 40° C. and spun. A detergent amount of 1 g/l to 3 g/l is used, depending on water hardness. The samples are laid on a flat surface until dry, and then they are conditioned for 16 hours at 20° C.+/−2° C. and 65% relative humidity +/−2% rh.

Fabric sample shrinkage is then measured in the warp and weft directions by measuring the distances between markings. The shrinkage after laundering, C %, is calculated as $$C\%=((L1-L2)/L1)\times 100,$$

where L1 is the original distance between markings (40 cm) and L2 is the distance after drying. The results are averaged for the samples and reported for both weft and warp directions. Negative shrinkage numbers reflect expansion, which is possible in some cases because of the hard yarn behavior.

APPLICATION EXAMPLES

For each of the following eight examples, composite yarns containing Lycra® spandex and a hard yarn were first prepared using the size-covering method of the present invention. Table 1 lists the materials and process conditions that were used to manufacture the composite yarns for each example. For example, in the column headed "Lycra®", 40 d means 40 denier before drafting; T162 or T563B refers to commercially available types of Lycra® spandex; and 3.5× means the draft of the Lycra® spandex imposed by the sizing machine (machine draft). For example, in the column headed "Hard Yarn", 20 Ne is the linear density of the spun yarn as measured by the English Cotton Count System, whereas 50 d, 34 fil is a 50 denier continuous multifilament yarn of 34 filaments. The rest of the items in Table 1 are clearly labeled.

Stretch fabrics were subsequently made, using the composite yarn of each example in Table 1. The size-covered composite yarns were used as weft yarns in woven and as feed yarns for weft-knit fabrics. For the woven fabrics, the warp yarns were either spun cotton yarns or synthetic polyester false-twist textured continuous multifilament yarns.

TABLE 1

| Size-Covered Composite Yarns | | | | | | | | | |
|---|---|---|---|---|---|---|---|---|---|
| | Composite Yarns | | Sizing Process | | | | | | |
| Example | Lycra* | Hard Yarn | Size Type | Composite Yarn Speed, m/min | Sizing Bath, % Solids | Sizing Bath Temp, ° C. | Dry Temp, ° C. | Dry Res Time, minutes | Bond Stability Pass/Fail |
| 1 | 40d, T162, 3.5X | Cotton, 20Ne | PVA | 274 | 12.5 | 42 | 88 | 5 | Pass |
| 2 | 70d, T563B, 3.8X | Cotton, 10Ne | PVA | 274 | 12.5 | 49 | 83 | 5 | Pass |
| 3 | 40d, T162, 3.5X | Polyester, textured, 150d, 50 fil | PVA | 274 | 12.5 | 42 | 88 | 5 | Pass |
| 4 | 40d, melt spun, 3.8X | Nylon, textured, 75d, 34 fil | PVA | 274 | 12.5 | 49 | 83 | 5 | Pass |
| 5 | 40d, T162, 3.5X | Cotton, 30Ne, Ring Spun | PVA | 274 | 12.5 | 42 | 88 | 5 | Pass |
| 6 | 40d, T162, 3.8X | Cotton, 20Ne | PVA | 274 | 12.5 | 49 | 83 | 5 | Pass |
| 7 | 20d, T162, 2.5X | Cotton, 20Ne | PVA | 274 | 12.5 | 49 | 83 | 5 | Pass |
| 8 | 140d, T162, 4.0X | Cotton, 10Ne | PVA | 274 | 12.5 | 49 | 83 | 5 | Pass |

Table 2 summarizes the yarns used in the fabrics, the weave or knit pattern, the weaving or knitting performance, and the quality characteristics of the fabrics. Some additional comments for each of the examples are given below.

TABLE 2

| Stretch Fabrics with Size-Covered Composite Yarns | | | | | | | | | | |
|---|---|---|---|---|---|---|---|---|---|---|
| Example | Weft Yarn | Warp Yarn | Weave Pattern | Knit Pattern | Weaving or Knitting Performance | Fabric End Use | Fabric % Weft Elongation | Fabric % Growth | Fabric % Srinkage, warp × weft | Fabric Weight, gm/m2 |
| 1 | Composite Elastic | Cotton, 16Ne, Ring | 1/3 Twill | | Acceptable | Stretch Cotton Khaki | 34% | 3.90% | 4.3% × 3.2% | 297 |
| 2 | Composite Elastic | Cotton, 10Ne Open End | 1/3 Twill | | Acceptable | Stretch Cotton Denim | 60% and 54% | 4% | 2.3% × 0.6% | 381 |
| 3 | Composite Elastic | Polyester, textured, 150d, 50 fil | 1/3 Twill | | Acceptable | Stretch Polyester Woven | 21% | 4.30% | (0.2%) × 0.0% | 246 |
| 4 | Composite Elastic | Cotton, 40Ne, Ring | 1/3 Twill | | Acceptable | Stretch Shirting | 16.50% | 1.80% | (1.0)% × (0.6)% | 139 |
| 5 | Composite Elastic | Cotton, 40Ne, Ring | 1/1 Twill | | Acceptable | Stretch Cotton Poplin | 13.20% | 9.70% | 4.5% × 2.1% | 143 |
| 6 | Composite Elastic | Cotton, 20Ne Open End | 1/3 Twill | | Acceptable | Yarn-Dyed Strip Fabric | 31% | 3% | 2.3% × 1.5% | 244 |
| 7 | Composite Elastic | | | Circular Flat Knit | | | 140% | | 3% × 4.5% | 255 |
| 8 | Composite Elastic | Polyester, textured, 150d, 50 fil | 1/3 Twill | | Acceptable | Blend Stretch Fabric | 33.10% | 2.50% | (0.2)% × 0.4% | 353 |

Example 1

Woven Stretch Cotton Khakis

The warp yarn was 16 Ne count of ring spun yarn with 3.8 twists/meter (t/m). Loom speed was 478 picks per minute at a pick level 50 Picks per inch. After desizing and scouring, the fabric was dyed with a blue color. After heatset, the fabric was 46.5 inch wide.

Example 2

Woven Stretch Cotton Denim

The warp yarn was 10 Ne open end spun cotton, and was dyed indigo before weaving. The weft yarn was 10 Ne cotton/70 D easy-set (T563B) Lycra® size-covered yarn. The loom speed was 400 picks/minute at 38 picks per inch. The fabric was denim stone washed and had 60% available stretch and 4% growth after the wash. The fabric had 54% available stretch after passing through bleaching solutions of 10% chlorite at 30 degrees C. and 11 pH for 30 minutes.

Example 3

Woven Stretch Polyester Fabric

The loom speed was 500 picks per minute at 55 Picks per inch. After desizing and scouring, the fabric was dyed with a khaki color at 110 degrees C. Finished fabric end counts were 105 ends per inch (EPI) in the warp, and 73 picks per inch (PPI) in the weft.

Example 4

Woven Stretch Shirting

The warp yarn was 40 cc ring spun cotton and the weft yarn was 75 D Nylon/40D experimental melt-spun Lycra®. The loom speed was 400 picks/minute at 65 picks per inch. Finished fabric end counts were 135 EPI and 75 PPI in warp and weft directions, respectively.

Example 5

Woven Stretch Cotton Poplin

The loom had 12 harnesses with a warp density of 96 ends per inch. The Lycra® spandex content in the fabric was 3.48% of the fabric weight. Finished fabric end counts were 135 EPI and 68 PPI in warp and weft directions, respectively.

Example 6

Yarn Dyed Strip Woven Fabric

The 20 Ne cotton yarn used in the composite weft yarn was dyed a blue color in the package format before combining with the 40 denier Lycra® fiber and size covering. The loom speed was 500 picks/minute at 55 picks per inch. Because the arrangement of colored yarn and white yarn in weft direction was 4:4, color strips were formed in the fabric weft direction.

Example 7

Circular Knit Stretch Fabric

The needle count was 168 per inch and the cylinder diameter was 3.75 inch. The fabric was scoured at 82 degrees C. for 30 minutes, using 1.0 g/l Merpol*LHP and 0.5 g/l. caustic and then cooled to 76.5 degrees C. and rinsed. The ratio of fabric weight to water weight was 1:30. The wet fabric was then neutralized to 7.0 pH with acetic acid for 10 minutes at 37.8 degrees C. The fabric was finally steamed at 270 F in a Hoffman press for three cycles of 15 seconds of steam followed by 15 seconds of vacuum. The knit sample was small and as a result knitting performance was not quantified.

Example 8

Blended Stretch Woven Fabric

The loom speed was 500 picks per minute at 45 Picks per inch. The width of the fabric was 80 inches in the loom. Finished fabric end counts were 111 EPI and 62 PPI in the warp and weft directions, respectively.

Though the invention has been described in terms of preferred embodiments, it will be obvious that the same may be varied in many ways. Such variations are not to be regarded as a departure from the spirit and scope of the invention and all such modifications, as would be obvious to one skilled in the art, are intended to be included within the scope of the following claims.

What is claimed is:

1. A method for making a composite yarn, comprising:

stretching a strand of one or more elastomeric fibers in a range from 1.1× to 5× of a relaxed length of the strand;

aligning at least one hard yarn selected from the group consisting of synthetic fibers, natural fibers and a blend of synthetic and natural fibers, adjacent and substantially parallel to said stretched strand to form an aligned yarn;

applying a size material to said aligned yarn, wherein said size material comprises a sizing agent and optionally a wax, further wherein said size material is applied to said yarn by an aqueous or hot-melt process, and when said sizing agent is applied by an aqueous process, said size material is dissolved in water to form a solution before the size material is applied to the aligned yarn wherein concentration of the size material in the solution is from 5% to 25% by weight, and when said sizing agent is applied by a hot-melt process, said size material is applied to the aligned yarn in an amount from 3% and 6% by weight based on the aligned yarn pre-sized weight, and when wax is present in said size material, said wax is present in amounts not exceeding 1 weight % based on the solids weight of the sizing agent; and drying or curing the size material to form a composite yarn.

2. The method of claim 1, further comprising entangling surface fibers of the at least one hard yarn aligned with said strand of one or more elastomeric fibers, wherein said entangling is done prior to applying a size material to the aligned yarn.

3. The method of claim 1, wherein the strand comprises a spandex yarn of a denier of from 20 to 140, and wherein the hard yarn has a total denier of from 45 to 900.

4. The method of claim 1, wherein said sizing agent is selected from the group consisting of: starch, acrylic polymer, PVA and CMC.

5. The method of claim 1, wherein the sizing agent is applied by a hot-melt process and is a hot-melt polymer.

6. The method of claim 4, wherein the size material is applied by an aqueous process.

7. The method of claim 5, wherein the hot-melt polymer is selected from the group consisting of: acrylate ester and methacrylate ester, and wherein the concentration of wax, if present, is up to 1% by weight.

* * * * *